US006682109B2

(12) United States Patent
Horne et al.

(10) Patent No.: US 6,682,109 B2
(45) Date of Patent: Jan. 27, 2004

(54) DOOR LATCHING MECHANISM

(75) Inventors: David Horne, South Wonston (GB); Neil C. Fletcher, Hounsdown (GB)

(73) Assignee: APW Ltd., Waukesha, WI (US)

( * ) Notice: Subject to any disclaimer, the term of this patent is extended or adjusted under 35 U.S.C. 154(b) by 0 days.

(21) Appl. No.: 09/903,335

(22) Filed: Jul. 11, 2001

(65) Prior Publication Data

US 2002/0089184 A1 Jul. 11, 2002

(30) Foreign Application Priority Data

Jul. 11, 2000 (GB) ..... 0016854

(51) Int. Cl.[7] ..... E05C 9/00

(52) U.S. Cl. ..... 292/22; 292/39; 292/51; 292/DIG. 61

(58) Field of Search ..... 292/22, 39, 51, 292/DIG. 61, 332, 160, 172, 142

(56) References Cited

U.S. PATENT DOCUMENTS

| | | | | |
|---|---|---|---|---|
| 2,672,745 A | | 3/1954 | Marchetti | |
| 4,288,944 A | * | 9/1981 | Donovan | 49/395 |
| 5,253,903 A | * | 10/1993 | Daley | 292/39 |
| 5,375,894 A | | 12/1994 | Schlack | |
| 5,603,534 A | * | 2/1997 | Fuller | 292/2 |
| 5,865,479 A | * | 2/1999 | Viney | 292/39 |
| 5,890,753 A | | 4/1999 | Fuller | |
| 6,283,516 B1 | * | 9/2001 | Viney | 292/160 |
| 6,386,599 B1 | * | 5/2002 | Chevalier | 292/201 |
| 6,478,345 B1 | * | 11/2002 | Viney | 292/39 |

FOREIGN PATENT DOCUMENTS

| | | |
|---|---|---|
| DE | 91 04 260 U1 | 9/1992 |
| DE | 93 04 893.9 U1 | 9/1993 |
| DE | 93 04 949.8 U1 | 9/1993 |
| DE | 297 05 508 U1 | 7/1997 |
| DE | 297 05 778 U1 | 7/1997 |
| DE | 299 13 805 U1 | 12/1999 |
| EP | 0 955 432 A2 | 11/1999 |
| GB | 2 289 084 A | 11/1995 |
| WO | WO 94/15050 | 7/1994 |
| WO | WO 98/42938 | 10/1998 |
| WO | 98/44223 | 10/1998 |
| WO | WO 99/18313 | 4/1999 |

* cited by examiner

*Primary Examiner*—Robert J. Sandy
*Assistant Examiner*—Dinesh N Melwani
(74) *Attorney, Agent, or Firm*—Quarles & Brady LLP

(57) ABSTRACT

A door latching mechanism comprises two oppositely-directed, vertically-slideable rods adapted to engage at their outer ends respectively with the top and bottom of a door frame, and a main latch member adapted to engage with a keeper provided on or in the side of the door frame, the latching mechanism comprising a push rod actuating assembly which is connected between the inner ends of the push rods and is engaged by the main latch member, and is so arranged, in use, to urge the push rods in opposite outward directions on latching engagement of the main latch member with the door side frame, the push rod actuating assembly comprising an actuating assembly housing in or on which is mounted first and second gear pinions that are respectively meshed with vertically slideable oppositely-directed push rod bars connected to the respective inner ends of the push rods, the pinions being meshed with respective racks provided on opposite sides of a slider which is slideable substantially horizontally relative to the housing, the main latch member connecting with the slider whereby on release of the main latch member from the keeper, the slider is moved to draw the push rods towards one another.

6 Claims, 3 Drawing Sheets

50
18
19
21
20
22
23
24
25
51

DOOR LATCHING MECHANISM

This invention relates to door latching mechanisms and particularly, but not exclusively, to door latching mechanisms for the door of an enclosure for housing electronic equipment and electrical cabling and associated equipment.

The doors of such enclosures generally comprise a metal panel with a reinforced edge section to provide rigidity to the door, and the edge section is desirably a box-section.

It is desirable that a latching mechanism is provided which is engaged on slamming shut the door, and we consider it desirable that the latching mechanism should be capable of being housed substantially within the reinforced edge section extending along one vertical edge of the door.

This means that any moving parts of the mechanism are unlikely to come into contact with any cabling housed within the enclosure.

According to one aspect of the invention a door latching mechanism comprises two oppositely-directed, vertically-slidable rods adapted to engage at their outer ends respectively with the top and bottom of a door frame, and a main latch member adapted to engage with a keeper provided on or in the side of the door frame, the latching mechanism comprising a push rod actuating assembly which is connected between the inner ends of the push rods and is engaged by the main latch member, and is so arranged, in use, to urge the push rods in opposite outward directions on latching engagement of the main latch member with the door side frame, the push rod actuating assembly comprising an actuating assembly housing in or on which is mounted first and second gear pinions that are respectively meshed with vertically slidable oppositely-directed push rod bars connected to the respective inner ends of the push rods, the pinions being meshed with respective racks provided on opposite sides of a slider which is slidable substantially horizontally relative to the housing, the main latch member connecting with the slider whereby on release of the main latch member from the keeper, the slider is moved to draw the push rods towards one another.

According to a second aspect of the invention we provide a push rod actuating assembly suitable for use in a door latching mechanism in accordance with the first aspect of the invention, the actuating assembly comprising an actuating assembly housing in or on which is mounted first and second gear pinions that are respectively meshed with slidable oppositely-directed push rod bars adapted to be connected in use at their outer ends to the respective inner ends of a pair of oppositely-directed push rods, the pinions being meshed with respective racks provided on opposite sides of a slider which is slidable substantially transversely of the direction of sliding movement of the push rod bars, the slider being adapted to be operable by a connection from a main door latching member.

The push rod actuating assembly substantially counterbalances the weight of the upper push rod by that of the lower push rod, whereby only frictional forces need to be overcome in urging the push rods outwardly so that a reduced slamming force is required to provide an effective three-point locking action of the door to the door frame.

The two push rods, which may be of any convenient cross-section such as oblong-rectangular, are preferably axially aligned with one another so as to slide along a common axis.

The push rod actuating assembly preferably comprises resilient means which acts so as to urge the push rod bars in opposite directions apart.

Although the resilient means may be associated with the slider, preferably the resilient means comprises a tension spring connected between spring anchors provided on the respective pinions, and conveniently the pinions each comprise a toothless portion to accommodate the spring anchors.

The slider is preferably provided with an aperture to receive a connection from the main latch member, the housing containing one or more corresponding access apertures.

Preferably the housing is of substantially rectangular shallow box shape, and opposite side walls of the housing are provided with said access apertures to enable said connections to extend through the housing and slider.

A door latching mechanism and a push rod actuating assembly therefor, both in accordance with the invention, will now be described, by way of example only, with reference to the accompanying drawings, in which.

Figure 1:
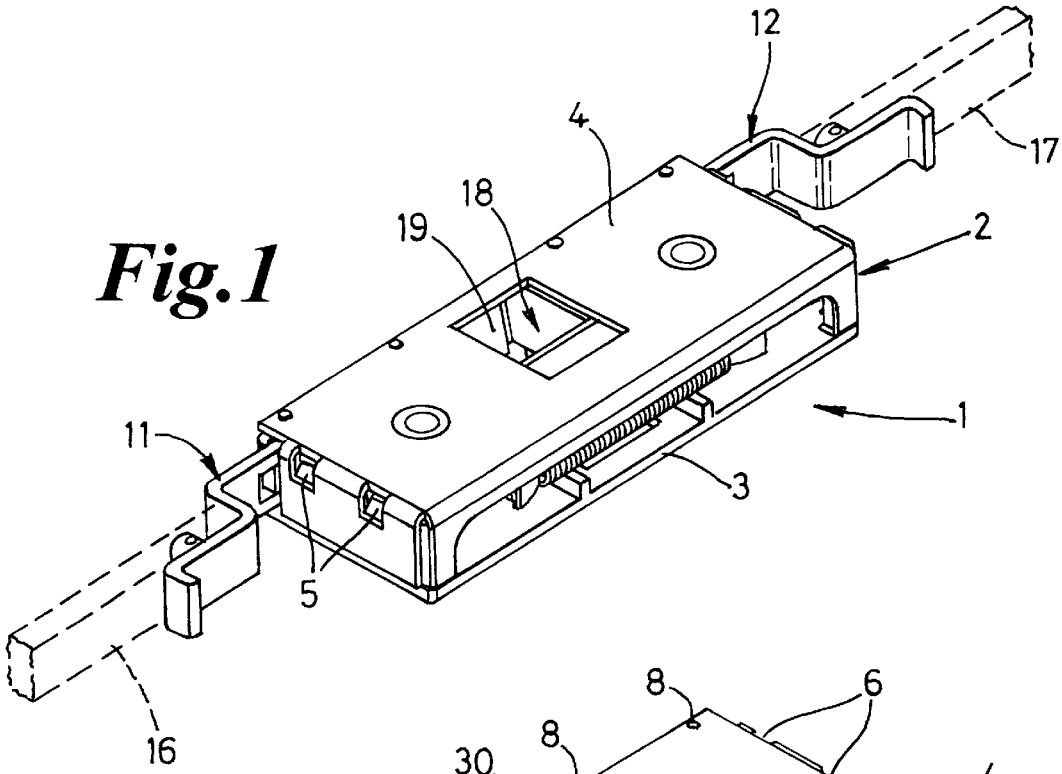
FIG. 1 is a perspective view of an assembled push rod actuating assembly and showing in broken outline the inner ends of a pair of oppositely-directed push rods.
Figure 3:
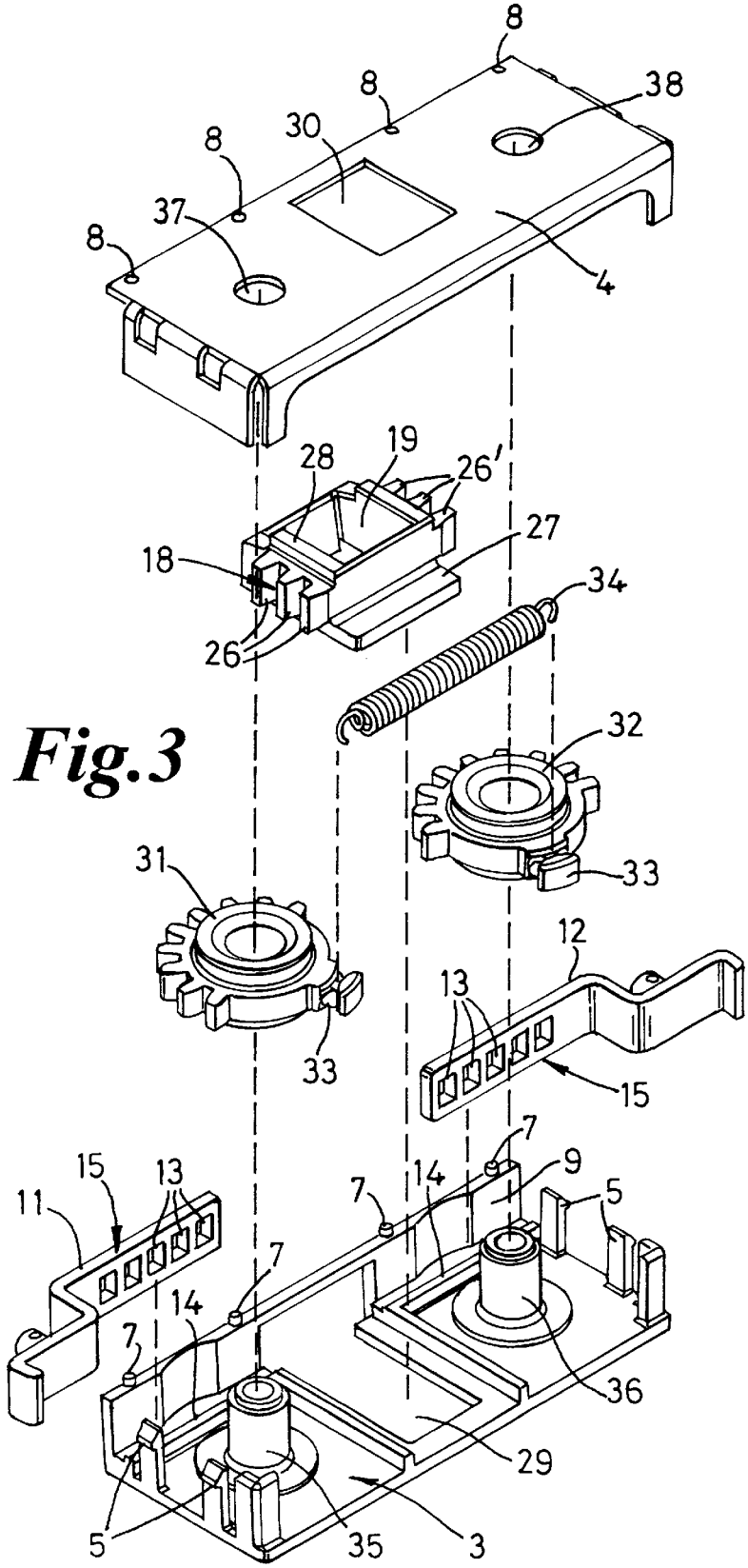
Figure 4:
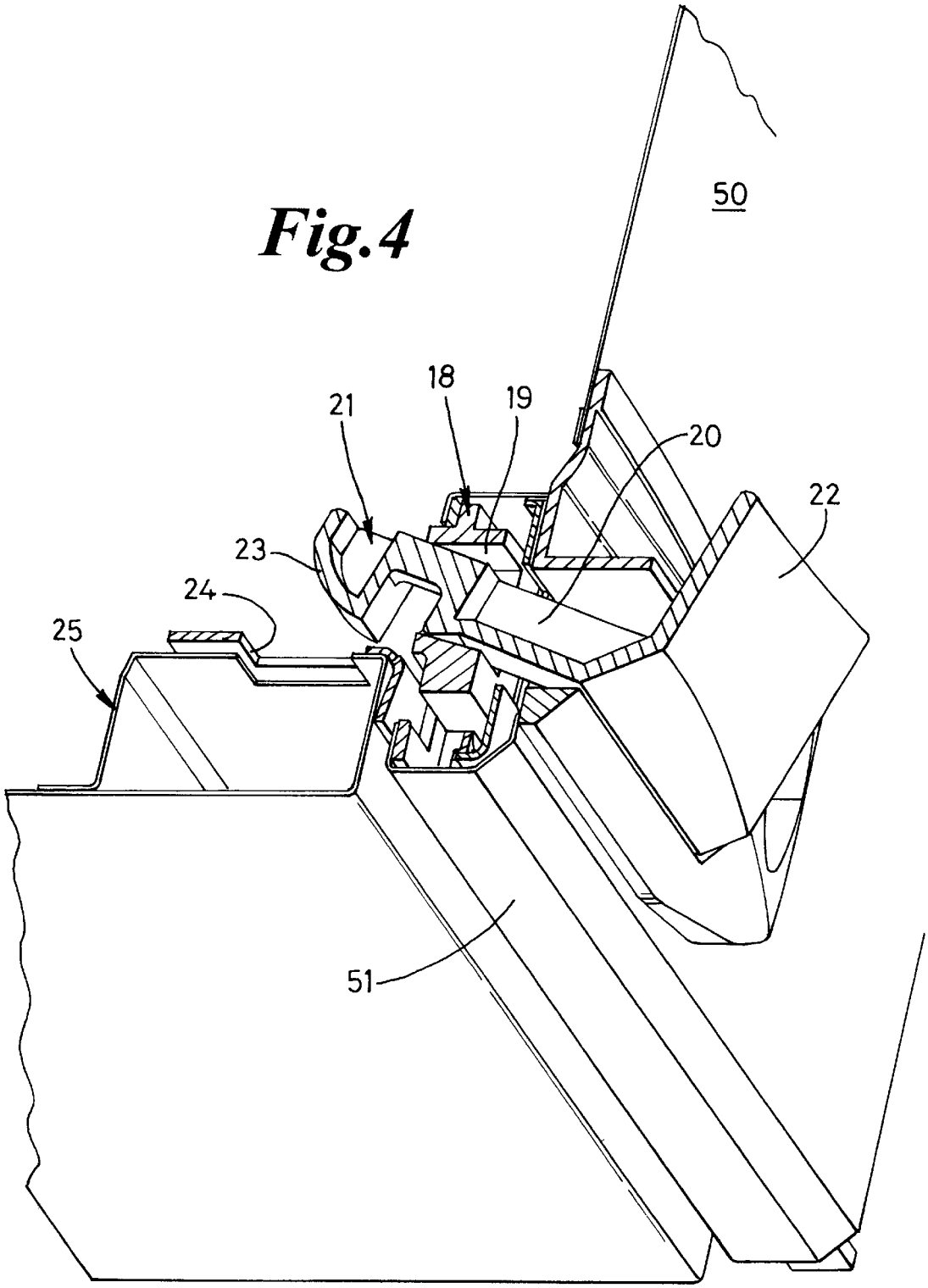

FIG. 3 is an exploded perspective view of the actuating assembly of FIG. 1; and FIG. 4 is a cross-sectional perspective view of the latching mechanism incorporating the push rod actuating assembly of FIG. 1, mounted in the vertical edge of a door of an electrical enclosure, the door, push rod actuating assembly and main latch member being sectioned on a horizontal plane, the main latch member being shown in an unlatched condition.

Figure 2:
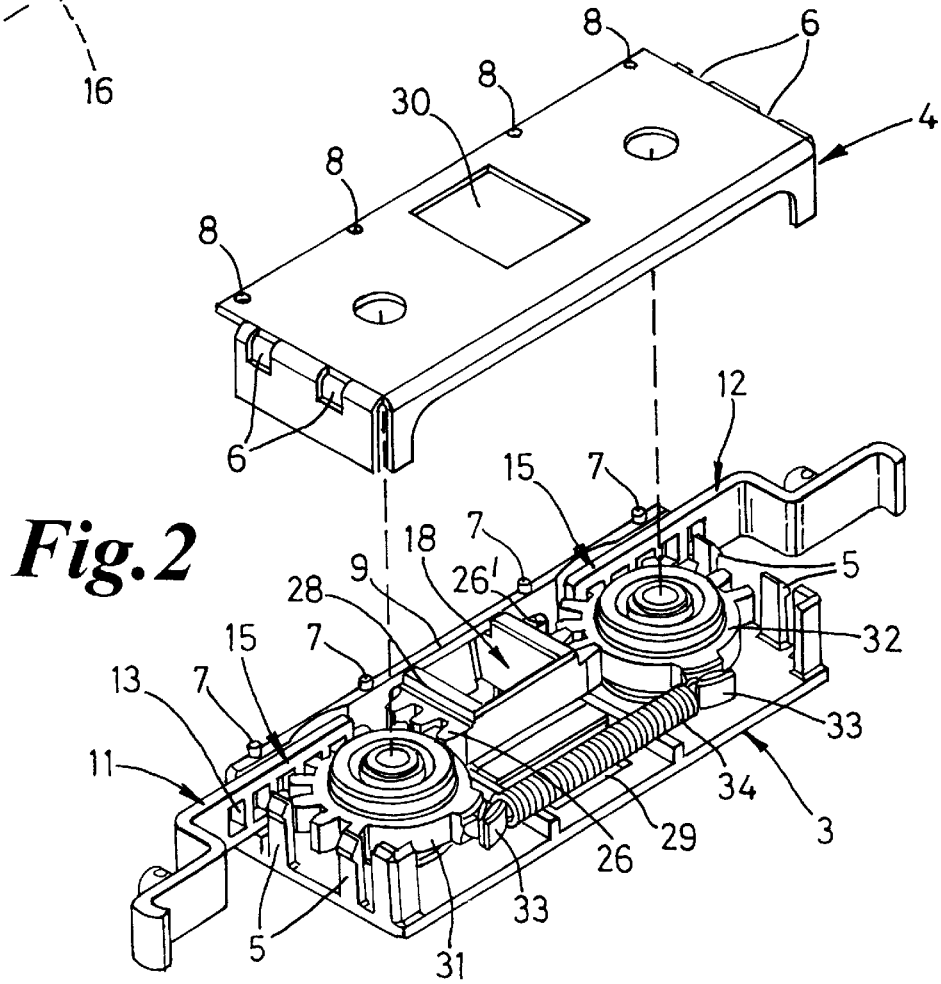
FIG. 2 shows the assembly of FIG. 1 but with the housing cover removed.

With reference to FIGS. 1, 2 and 3, a push rod actuating assembly 1 comprises a metal housing 2 consisting of a die-cast housing base 3 of oblong-rectangular outline, and a pressed metal housing cover 4, the housing base 3 being provided at opposite ends with a pair of upstanding retaining fingers 5 which engage with windows 6 provided in the opposite end corners of the cover 4, locating pegs 7 on upstanding housing sidewall 9 co-operating with locating holes 8.

A pair of cranked push rod bars 11, 12 each have their inner ends punched with a series of rack cutouts 13 to define respective racks 15 and are slidably guided against the housing wall 9 by elongate ribs 14 on the housing base 3. The outer ends of the push rod bars 11, 12 connect in use, as indicated in FIG. 1, with respective push rods 16, 17.

A slider 18 is in the form of a generally square framework to define a central aperture 19 to receive the arm 20, FIG. 4, of a main latch member 21, the latch member arm 20 being pivoted with respect to the door 50 by a vertical pivot, not shown, for releasing the door on pulling on a door release handle 22 fast with arm 20. A latch head 23 is adapted to engage a keeper 24 mounted on a vertical box section 25 of the cabinet door surround.

As shown in FIGS. 2 and 3, the slider 18 is provided on opposed sides with sets of three rack teeth 26, 26' and the teeth 26, 26' are of reduced height (in FIG. 3) compared with the overall height of the slider whereby a projecting rectangular slider base 27 and a projecting rectangular slider top 28 are defined, the slider base 27 and top 28 being received in rectangular cutouts 29, 30 respectively in the housing base 3 and housing cover 4 respectively to resist tilting of the slider 18. The teeth 26 are slidable between the upper surface of base 3 and undersurface of cover 4.

First and second pinions 31, 32 each have pinion teeth for half of their circumference, and each have a radially-projecting spring anchors 33 for a coiled tension spring 34. The pinions 31, 32 are rotatable on tubular bosses 35, 36 upstanding from the base 3 and have reduced-diameter upper ends received in holes 37, 38 in housing cover 4.

The pinion teeth of pinion 31 mesh with rack 15 on the push rod bar 11 and with the teeth 26 on one side of the slider 18, whereas the pinion teeth of pinion 32 mesh with the rack 15 on push rod bar 12 and with the teeth 26' on the other side of the slider 18.

It will be appreciated that in use the weights of the push rods 16, 17 are counterbalanced in the actuating assembly 1 since, if the push rod 17 is the upper rod, the weight of that upper rod will tend to drive pinion 32 in one direction whereas the weight of the lower rod 16 will tend to drive pinion 31 in the same direction, such that the pinions are attempting to drive the slider 18 in opposite directions. Spring 34 urges pinions 31, 32 in the directions to bias the upper push rod 17 upwards, and the lower push rod 16 downwards, and in FIG. 2 the push rod bars 11, 12 are shown in their fully projected condition in which the slider 18 has been driven against the left hand margin of cutout 30 by the action of spring 29.

When the door release handle 22, FIG. 4, is pulled, the resulting pivoting of latch arm 20 is accommodated by sliding movement of the slider 18 from the (latched) position shown in FIG. 2 to the right hand end of slot 30 in FIG. 2, thereby driving pinions 31, 32 to withdraw the push rods 16, 17 from keepers at the top and bottom of the cabinet door.

Thus, operation of the door handle 22 releases the main latch member 21 and withdraws the push rods 16, 17.

When the door is in the open condition, spring 34 acts to return the slider 18 to the condition of FIG. 2. On slamming shut of the door 50, the rounded nose of the latch member 21 will pivot the latch arm 20 to operate slider 18 so as to withdraw the push rods 16, 17, thereby allowing the door to close fully, and then as the latch member 21 fully engages with the keeper 24, the slider 18 will return to bring the rods 16, 17 to the fully projected condition.

The illustrated actuating assembly 1 can be accommodated within the vertical box-section reinforcement 51 of the door 50, and since only an aperture is required to accommodate the latch arm 20, the integrity of the reinforcement 51 is substantially maintained.

It will be appreciated that, if desired, a key-operated locking or latch-releasing mechanism may be incorporated in the mechanism described.

What is claimed is:

1. A door latching mechanism comprising two oppositely-directed, vertically-slidable rods for engaging at their outer ends respectively with the top and bottom of a door frame, and a main latch member for engaging with a keeper provided on or in the side of the door frame, the latching mechanism comprising a push rod actuating assembly which is connected between the inner ends of the push rods and is engaged by the main latch member, and is so arranged, in use, to urge the push rods in opposite outward directions on latching engagement of the main latch member with the door side frame, the push rod actuating assembly comprising an actuating assembly housing in or on which is mounted first and second gear pinions that are respectively meshed with first and second racks provided in vertically slideable oppositely-directed push rod bars connected to the respective inner ends of the push rods, the pinions each including a spring anchor between which a tension spring is connected to urge the push bars in opposite directions apart, the pinions being further meshed with respective racks provided on opposite sides of a slider which is slideable substantially horizontally relative to the housing, the main latch member connecting with the slider whereby on release of the main latch member from the keeper, the slider is moved to draw the push rods towards one another.

2. A door latching mechanism as claimed in claim 1 wherein the two push rods are axially aligned with one another so as to slide along a common axis.

3. A door latching mechanism as claimed in claim 1 in which the pinions each comprise a toothless portion to accommodate the spring anchors.

4. A door latching mechanism as claimed in claim 1 in which the slider is provided with an aperture to receive a connection from the main latch member, the housing containing at least one corresponding access aperture.

5. A door latching mechanism as claimed in claim 4 wherein the housing is of substantially rectangular shallow box shape, and opposite side walls of the housing are each provided with one of said at least one access aperture to enable said connection to extend through the housing and slider.

6. A door latching mechanism as claimed in claim 1, in which the main latch member is connected to the door by a pivot and extends through the slider at a position along the latch member which is spaced from the pivot so that pivoting of the main latch member slides the main door latch member along the slider so as to move the slider to draw the push rods toward one another.

* * * * *

UNITED STATES PATENT AND TRADEMARK OFFICE

CERTIFICATE OF CORRECTION

PATENT NO. : 6,682,109 B1
DATED : January 27, 2004
INVENTOR(S) : David Horne et al.

It is certified that error appears in the above-identified patent and that said Letters Patent is hereby corrected as shown below:

Title page,
Item [57], ABSTRACT,
Lines 1, 9 and 11, “slideable” should be -- slidable --.
Line 9, “vertically slidable” should be -- vertically-slidable --.

Column 4,
Line 11, “slideable” should be -- slidable --.

Signed and Sealed this

Thirtieth Day of November, 2004

JON W. DUDAS
*Director of the United States Patent and Trademark Office*